US012560333B2

(12) United States Patent
Heupel et al.

(10) Patent No.: US 12,560,333 B2
(45) Date of Patent: Feb. 24, 2026

(54) OPERATION OF APPLIANCES

(71) Applicant: BSH Hausgeraete GmbH, Munich (DE)

(72) Inventors: Sven Heupel, Neubiberg (DE); Christoph Soellner, Munich (DE)

(73) Assignee: BSH Hausgeraete GmbH, Munich (DE)

( * ) Notice: Subject to any disclaimer, the term of this patent is extended or adjusted under 35 U.S.C. 154(b) by 1010 days.

(21) Appl. No.: 17/762,593

(22) PCT Filed: Sep. 17, 2020

(86) PCT No.: PCT/EP2020/075944

§ 371 (c)(1),
(2) Date: Mar. 22, 2022

(87) PCT Pub. No.: WO2021/058363

PCT Pub. Date: Apr. 1, 2021

(65) Prior Publication Data

US 2022/0333786 A1 Oct. 20, 2022

(30) Foreign Application Priority Data

Sep. 24, 2019 (DE) ..... 10 2019 214 522.1

(51) Int. Cl.
*F24C 7/08* (2006.01)

(52) U.S. Cl.
CPC ..... *F24C 7/082* (2013.01)

(58) Field of Classification Search
CPC ..... F24C 7/082
USPC ..... 219/506
See application file for complete search history.

(56) References Cited

U.S. PATENT DOCUMENTS 5,380,985 A * 1/1995 Graham ..... F24C 7/087 219/446.1
5,717,188 A * 2/1998 Vaillancourt ..... H05B 1/0263 219/448.12
6,294,994 B1 * 9/2001 Hoellerich ..... F24C 7/08 219/490
8,215,800 B2 7/2012 Plank
(Continued)

FOREIGN PATENT DOCUMENTS

CN 106642725 A 5/2017
CN 207052258 U 2/2018
(Continued)

*Primary Examiner* — Jimmy Chou
(74) *Attorney, Agent, or Firm* — Laurence A. Greenberg; Werner H. Stemer; Ralph E. Locher

(57) ABSTRACT

An operating apparatus for a household appliance includes first and second structure-borne sound sensors and a processing facility. The structure-borne sound sensors are configured to be applied to the surface of a predetermined body in a manner spaced apart from one another. The processing facility is configured to determine, on the basis of sensor values from the structure-borne sound sensors, a location on the surface of the body at which a pulse was introduced into the body; to determine that the location is situated in a predetermined section of the surface; and to determine a function of the household appliance that is associated with the section. A method for controlling a household appliance is also provided.

9 Claims, 3 Drawing Sheets

(56) References Cited

U.S. PATENT DOCUMENTS

| | | | | |
|---|---|---|---|---|
| 11,666,177 | B2 * | 6/2023 | Berents | A47J 37/04 99/419 |
| 11,766,151 | B2 * | 9/2023 | Jenkins | G08B 5/22 340/539.27 |
| 2013/0206015 | A1 * | 8/2013 | Jacoby | A47J 37/07 99/330 |
| 2014/0120219 | A1 * | 5/2014 | Ewell, Jr. | H05B 1/0261 99/344 |
| 2014/0251987 | A1 * | 9/2014 | Reay | F24C 7/088 219/446.1 |
| 2015/0118630 | A1 * | 4/2015 | Ewell | A47J 31/525 432/32 |
| 2016/0022086 | A1 * | 1/2016 | Yuan | G10L 25/51 99/337 |
| 2016/0354867 | A1 * | 12/2016 | Matsuoka | B23K 26/24 |

FOREIGN PATENT DOCUMENTS

| | | | | |
|---|---|---|---|---|
| CN | 108153428 | A | 6/2018 | |
| DE | 102004008739 | A1 | 9/2005 | |
| DE | 102008051256 | A1 | 4/2010 | |
| DE | 102009026447 | A1 | 12/2010 | |
| DE | 102017123955 | A1 * | 4/2019 | G08B 13/1672 |
| EP | 2599424 | B1 | 3/2015 | |
| EP | 3112758 | A1 * | 1/2017 | F24C 7/083 |
| JP | 2013057555 | A * | 3/2013 | G01S 15/93 |
| WO | WO-2015078642 | A1 * | 6/2015 | G06F 1/181 |

* cited by examiner

OPERATION OF APPLIANCES

FIELD AND BACKGROUND OF THE INVENTION

The invention relates to the operation of an appliance by a user. In particular, the invention relates to the interactive operation of a household appliance.

A household appliance, for instance a cooker, a washing machine or a dishwasher, comprises an operating apparatus, which typically comprises a visual output facility and a manual input facility. The output facility can also be omitted for a specific appliance state. For instance, a dishwasher can project a status display onto a floor. The input facility can be actuated manually and can comprise, for instance, a button, a switch or a sensor surface.

EP 2 599 424 B1 proposes controlling a dishwasher by means of a series of knocks on the door of the appliance.

SUMMARY OF THE INVENTION

Known operating apparatuses are limited in their function and typically require a manual actuation. An object underlying the present invention consists in specifying an improved technology for operating a household appliance. The invention achieves this object by means of the subject matters of the independent claims. Subclaims reproduce preferred embodiments.

According to a first aspect of the invention, an operating apparatus for a household appliance comprises a first and a second structure-borne sound sensor and a processing facility. The structure-borne sound sensors are designed to be applied to the surface of a predetermined body in a manner spaced apart from one another. The processing facility is designed to determine, on the basis of sensor values of the structure-born sound sensors, a location on the surface of the body, at which a pulse was introduced into the body; to determine that the location is situated in a predetermined section of the surface; and to determine a function of the household appliance that is associated with the section.

By using two structure-borne sound sensors which are spaced apart from another, the location, at which the pulse was introduced into the body, can be determined more precisely. In particular, the location can be associated in an improved manner with one of possibly several predetermined sections. As a result, operation of the household appliance can take place in a differentiated manner. The pulse can be produced in particular by means of a user of the household appliance, for instance with a finger, a knuckle or a foot.

The determination of the location can be restricted to a region which is situated between the structure-borne sound sensors. Here a temporal difference, with which structure-borne sound arrives at the different sensors, can be associated uniquely with a location on a connection between the structure-borne sound sensors. The region can be localized for instance by boundaries or a structure of the body. The region can also be delimited for instance by means of a vibration-damping material, for instance. If pulses at more than one section are to be able to be differentiated from one another, the sections can be defined in a similar manner from one another.

In a first variant, the body is included in the household appliance. The body can comprise a housing, a cover, a door or a panel of the household appliance, for instance. The household appliance can comprise in particular a kitchen appliance. For instance, the household appliance can comprise a washing machine, a dishwasher, a cooker, an extractor hood or also a small appliance such as for instance a kettle or a toaster.

In a second variant, the body is not included in the household appliance. Here it is preferred that the household appliance be designed to rest against the body. The structure-borne sound sensors can therefore be applied in an improved manner to the household appliance and nevertheless have good contact with the body. In particular, the body can have a wall, wherein the household appliance is fastened to the wall, or a floor, wherein the household appliance is standing on the floor.

In a third variant, the household appliance can also be arranged separately from the surface. In this case, the structure-borne sound sensors and optionally also the processing facility can be applied to the body and a control connection with the household appliance can be provided. The control connection can be embodied in a wired or wireless manner.

It is further preferred for the operating apparatus to comprise a display apparatus for providing a visual indication on the surface. The display apparatus is preferably designed to represent the indication dynamically and in particular as a function of an operating state of the household appliance or the processing facility. A user guidance for the operation of the household appliance can therefore be realized in an improved manner. The display apparatus can operate vectorially and comprise for instance a deflectable laser, or a projection facility, which can represent for instance a matrix of controllable light points on the surface. The visual notification can indicate one or more predetermined sections and optionally additionally comprise an item of information relating to a function of the household appliance associated with the section. The information can comprise for instance a text or a pictogram. The visual indication or a part thereof can also be animated, by individual images, which can be perceived by the human eye as a moving image, being output quickly.

It is preferred that the display apparatus comprises a projector which is directed at the surface. The indication is projected here from the side onto the surface, from which the pulse can also be introduced. As a result, it is not necessary to use a transparent body. In particular, as a result a wall or a floor existing independently of the household appliance can be used in an improved manner for the operation.

The location can be determined with respect to a known propagation speed of structure-borne sound in the body. The determination of the location can be ambiguous with respect to a connection line of the two structure-borne sound sensors. If one of the locations does not come into consideration, for instance because the household appliance or another object is situated in this region of the body, two structure-borne sound sensors can be sufficient to determine the location. Otherwise, a third structure-borne sound sensor can be provided, wherein the structure-borne sound sensors are designed to be applied in pairs to the surface of the body in a manner spaced apart from one another. Here a constellation is to be avoided, in which the three structure-borne sound sensors are situated on a shared connecting line. In general, any number of structure-borne sound sensors can be used in order to improve the spatial resolution.

According to a second aspect of the invention, a method for controlling a household appliance comprises steps for detecting structure-borne sound at locations on a surface of a predetermined body which are spaced apart from one another; determining a location on the surface of the body, at which a pulse acts on the surface, said pulse producing the detected structure-borne sound; determining that the location is in a predetermined section of the surface; and determining a function of the household appliance associated with the section.

The method can be carried out in particular by means of an operating apparatus described herein, in particular its processing facility. To this end, the processing facility can comprise a programmable microcomputer or microcontroller and the method can exist in the form of a computer program product with program code means. The computer program product can be stored on a computer-readable data carrier. Features or advantages of the method can be transferred to the operating apparatus or vice versa.

The method can contribute to enabling a facilitated operation of the household appliance. The proposed unconventional mode of operation can be used more easily for instance by a person with physical disabilities or an older person. The method can involve triggering or controlling the specific function.

It is further preferred that a predetermined pulse is identified on the basis of a pattern of one or both control signals. The pattern can comprise in particular an amplitude. A sensor signal can firstly be evaluated if its amplitude exceeds a predetermined threshold value. An error detection, for instance by means of a quiet noise or a pulse introduced into the body from the structure-borne sound sensors can therefore not be used in an improved manner to control the household appliance. Faulty operation can therefore be ruled out in an improved manner.

The pattern can relate to a temporal course of the signal of one of the sensors. It is therefore possible to take into account how long a pulse to be evaluated is to last or how the development of its amplitude over time is to ensue for instance. A noise, which is significantly longer or shorter than the pattern in terms of time can thus be suppressed in an improved manner.

The pattern can relate to a frequency spectrum of the signal. If the pulse is introduced into a floor by a foot of a user, for instance, then the noise produced in the process on the surface of the body can increasingly comprise high frequencies, if the user wore a shoe, and can increasingly comprise low frequencies, if he was barefoot. Only such pulses which are to be ascribed to a user or predetermined use circumstances can be processed in an improved manner.

The pattern can be fixedly predetermined or a user can influence the pattern. In one embodiment, the user can teach the operating apparatus, by generating a pulse in a predetermined section so that signals of the structure-borne sound sensors produced in the process can be associated with the section.

In a further embodiment, the pattern can also be learnt automatically. For instance, a self-adapting filter, an observer or a Kalman filter can be used. In a further embodiment, a learning process can also be reproduced by means of a neural network, for instance.

DETAILED DESCRIPTION OF THE INVENTION

Figure 1:
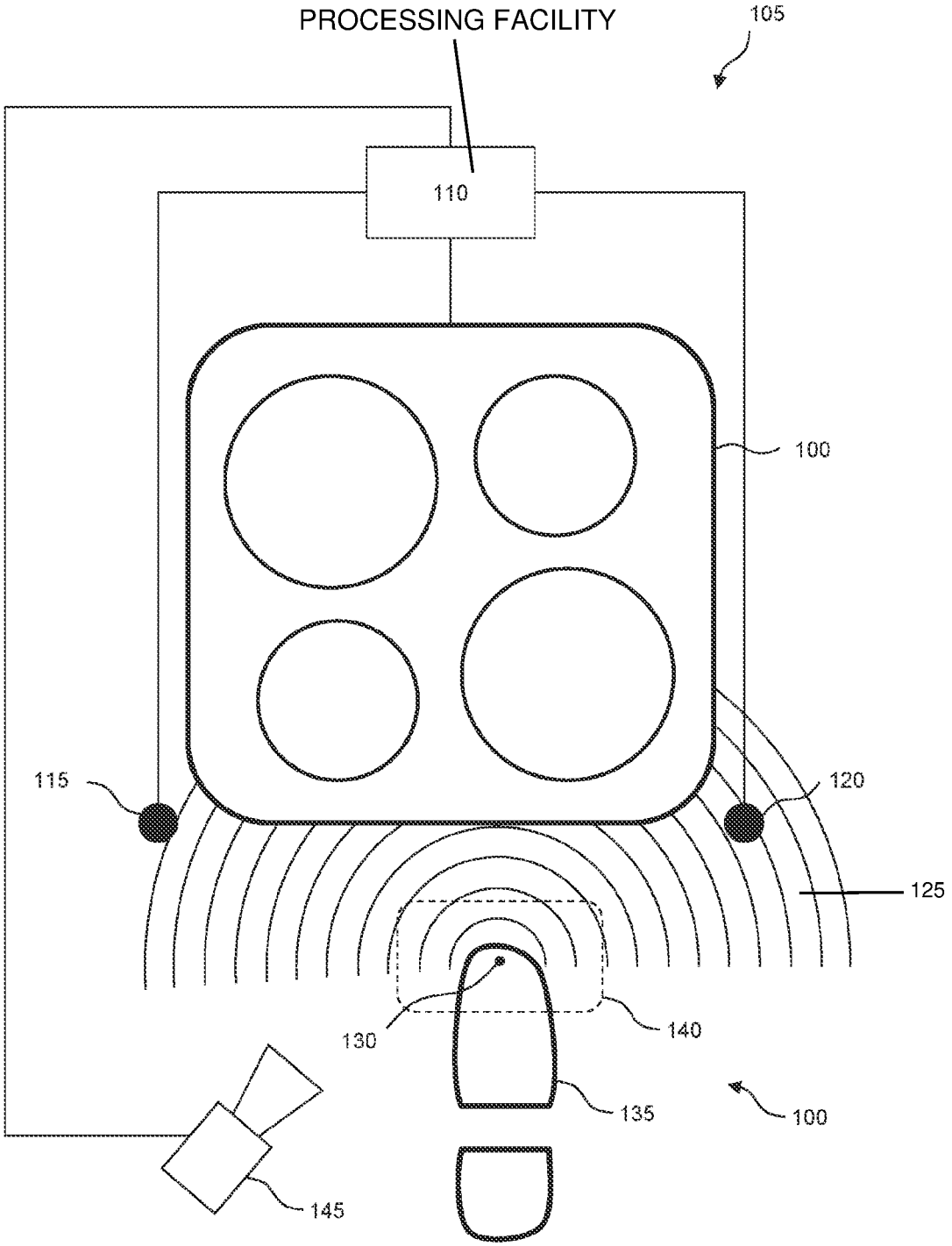
FIG. 1 shows an operating apparatus for a household appliance.

FIG. 1 shows a household appliance 100 with an operating apparatus 105. The household appliance 100 is shown by way of example as a cooker; in other embodiments any other household appliance, in particular a kitchen appliance, can also be used. The household appliance 100 is preferably designed to be used in a household, in particular a private household. The operating apparatus 105 comprises a processing facility 110, a first structure-borne sound sensor 115 and a second structure-borne sound sensor 120. Further structure-borne sound sensors can be added if necessary. The structure-borne sound sensors 115, 120 are designed to be applied to the surface of a body 125. It is generally preferred that the body is substantially flat in a region which comprises the predetermined section and possibly the two structure-borne sound sensors.

In the present embodiment, by way of example, the body 125 comprises a floor, on which a user can stand and with respect to which the household appliance 100 can be supported, for instance by means of a substructure. The structure-borne sound sensors 115, 120 are preferably applied to the household appliance 100 so that they rest against the body 125. The structure-borne sound sensors 115, 120 can be insulated against vibrations originating from the household appliance 100, for instance by means of elastic elements and/or dampers. In the case shown, the structure-borne sound sensors 115, 120 can be applied for instance to or in a stand of the household appliance 100 or in or on the substructure. In one embodiment, in which the body 125 is included in the household appliance 100, the structure-borne sound sensors 115, 120 can be applied directly to the body 125. In this context an application to the surface facing the user or another surface, in particular an opposing surface facing away from the user, is possible. If the body 125 comprises a sheet metal, for instance, then the structure-borne sound sensors 115, 120 can optionally be applied to an inner or an outer side of the sheet metal.

The structure-borne sounds sensors 115, 120 are designed to detect surface waves on the body 125, which are triggered by a pulse on its surface. The surface waves can lie in a predetermined frequency spectrum. In one embodiment, only surface waves are evaluated, the frequency of which lie in a region which is audible to a human. In this case, mention can also be made to acoustic surface waves or structure-borne sound. If a pulse is introduced in the body 125 at a location 130, for instance by means of a user 135, the waves on the surface of the body 125 expand in the direction of the structure-borne sound sensors 115, 120. For instance, the location 130 can be determined at least approximately on the basis of points in time by means of triangulation, at which points in time surface waves corresponding to one another were received at the structure-borne sounds sensors 115, 120. To this end, a runtime difference can be determined in particular, in other words a time difference between the arrival of structure-borne sound at the first structure-borne sound sensor 115 and the arrival at the second structure-borne sounds sensor 120.

Two structure-borne sounds sensors 115, 120 are already adequate for a determination of the location 130 along a direction which is provided by a straight line through the structure-borne sound sensors 115, 120. If the distance of the location 130 from the straight line is also to be determined, a third structure-borne sound sensor which does not lie on the straight line can be provided. Further structure-borne sound sensors on the surface of the body 125 can be used to improve the accuracy of the specific location 130.

The processing facility 110 is preferably designed to determine whether the determined location 130 is situated in a predetermined section 140 of the surface of the body 125. A function of the household appliance 100 can be associated with the section 140, which can be determined by the processing facility 110. The function can then be selected, controlled or carried out.

In a further embodiment, a numerical value can be correspondingly expressed for instance by generating a pulse on the body 125. Area boundaries of a predetermined numerical region can be associated with the locations at which the structure-borne sounds sensors 115, 120 are applied. As a result, a scale can be defined, and the location 130 can be mapped onto the scale. In the embodiment shown, the value 0 can be associated with the first structure-borne sound sensor 115, for instance, and the value 10 can be associated with the second structure borne-sounds sensor 120. The value 6 can accordingly be associated approximately with the location 130 shown. Other area boundaries are likewise possible, and the scale can, besides linearly, also be subdivided logarithmically, for instance.

The user 135 can be informed about where a pulse has to be introduced into the body 125, in order to bring about a predetermined control of the household appliance 100. To this end, a display apparatus 145 can be provided, which can cast a visual indication onto the surface of the body 125. The display apparatus 145 can comprise an LCD or DLP projector, for instance. Alternatively, a vectorial output can also be provided by means of a deflectable laser.

Figure 2:
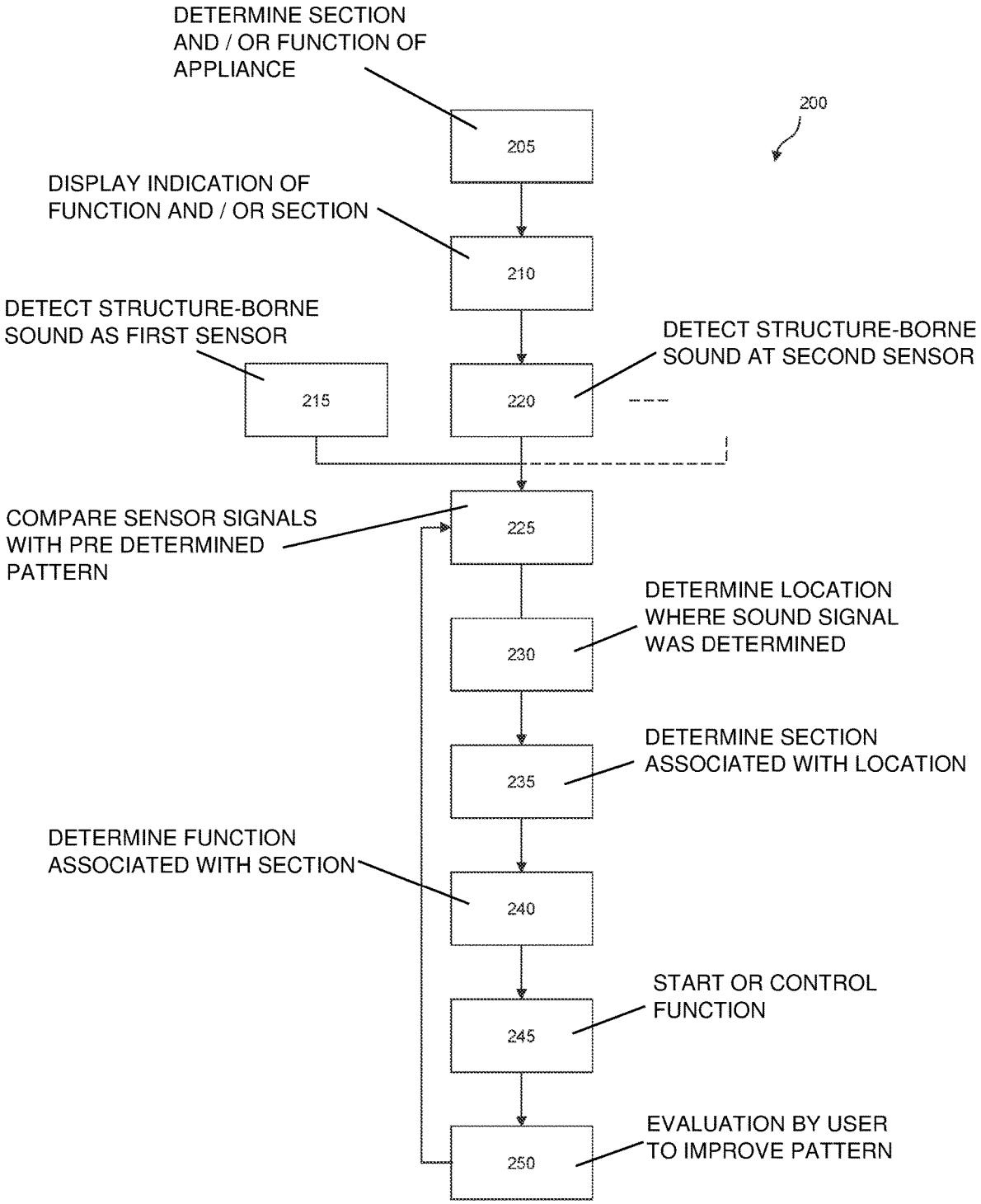
FIG. 2 shows a flow chart of a method.

FIG. 2 shows a flow chart of a method 200, which can be used to control a household appliance 100. The method 200 can be carried out in particular in conjunction with an operating apparatus 105 described herein.

In a first step 205, a section 140 and/or a function of the household appliance 100 can be determined. The function is preferably associated with the section 140 and can be determined dynamically as a function of an operating state of the household appliance 100. In a step 210, an indication to the specific function and/or the specific section 140 can be shown by means of the display apparatus 145 on the surface of the body 125. The indication can comprise a boundary of the section 140, for instance; a symbol or a text for characterizing the function can be included in the indication.

In a step 215, structure-borne sound can be detected on the first structure-borne sound sensor 115. At the same time, shortly before or shortly after, structure-borne sound can be detected in step 220 on the second structure-borne sound sensor 120. In further, concurrent steps, structure-borne sound can be detected in each case by one or more further structure-borne sound sensors in each case.

In a step 225, a signal of each of the structure-borne sounds sensors 115, 120 can be compared with a predetermined pattern. The pattern can be determined so that a pulse, which differs from a predetermined pulse introduced into the body 125 by a user 135, is not evaluated further. Moreover, the different sensor signals can be compared with one another in order to ensure that they resemble one another in a predetermined manner.

In a step 230, the location 130 can be determined on the basis of time differences, at which a structure-borne sound signal was determined on the different structure-borne sound sensors 115, 120. To this end, relative distances between the structure-borne sounds sensors 115, 120 are advantageously known.

In a step 235, a section 140 which is associated with the location 130 can be determined. The section 140 can correspond in particular to the section 140 shown in step 210. If the location 130 is outside of the section 140, no further processing can take place. In a step 240, a function of the household appliance 100 associated with the section 140 can be determined. This function may have been determined in step 205. An indication of the specific function can be output, for instance, to the user 135 or to a further control apparatus for controlling the household appliance 100. Alternatively, the function can also be started, controlled or carried out in step 245.

In an optional step 250, the pattern used in step 225 can be improved on the basis of the detected sensor signals. To this end, an evaluation of the user 135 can be obtained in order to determine whether or it not it agrees with the implemented determinations.

Figure 3:
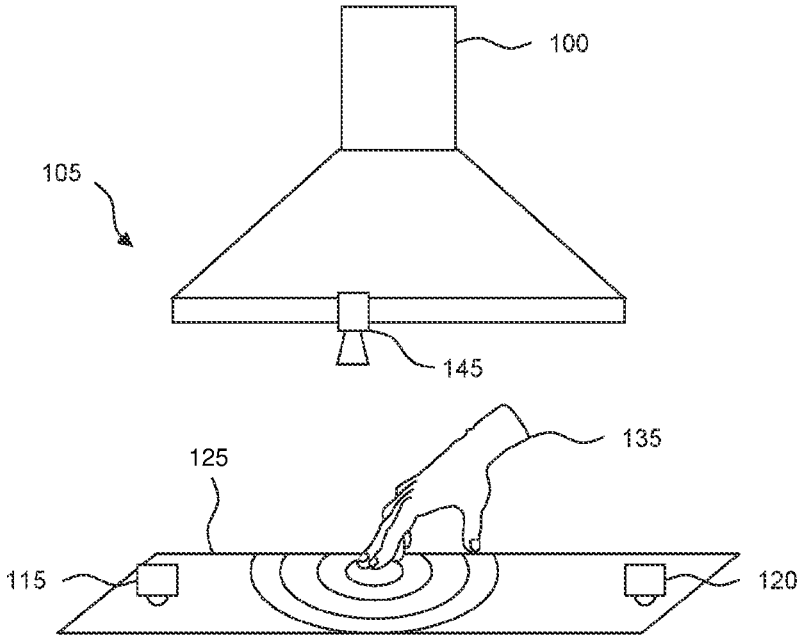
FIG. 3 shows a further embodiment of a control apparatus for a household appliance.

FIG. 3 shows a further embodiment of an operating apparatus 105 for a household appliance 100. In the embodiment shown, the household appliance 100 comprises by way of example an extractor hood or another appliance, which is applied at some distance from the body 125, which is embodied here as a cooker or work surface. In this case, the projection by means of the display apparatus 145 can take place from the household appliance 100. The structure-borne sound sensors 115, 120 can be applied to the surface of the body 125 separately from the household appliance 100.

Figure 4:
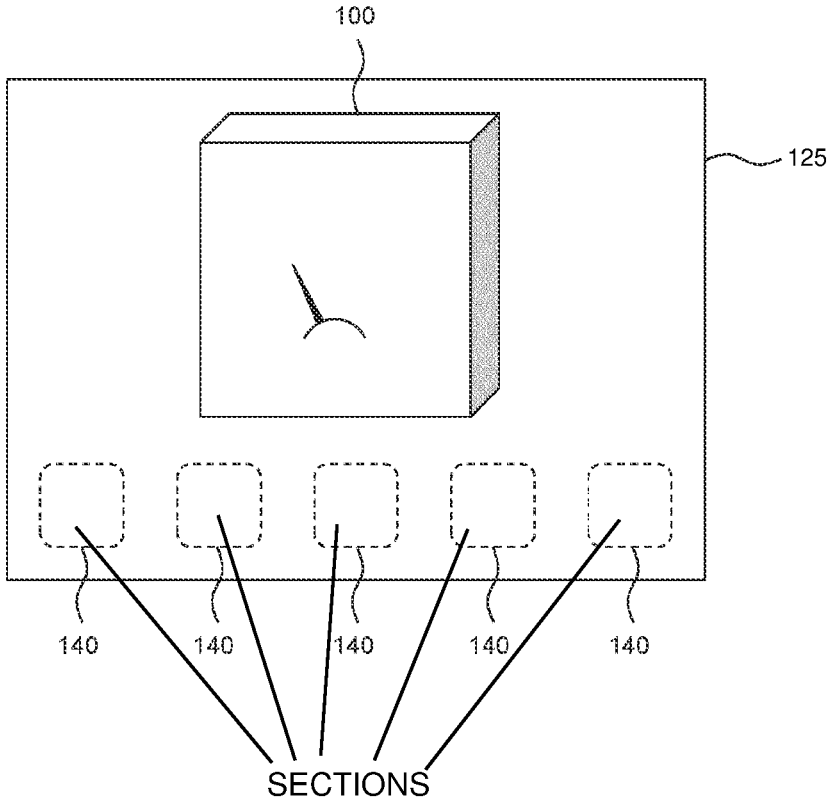
FIG. 4 shows yet another embodiment of an operating apparatus for a household appliance.

FIG. 4 shows yet another embodiment of an operating apparatus 105 for a household appliance 100. The household appliance 100 is applied to a wall which can be used as body 125. Purely by way of example the household appliance 100 is shown as scales, wherein the scale pan is not shown. The structure-borne sound sensors 115, 120 can rest against the wall 125; here they can be applied within a housing of the household appliance 100 or outside thereof. One or more sections 140 can be provided on the wall 125, which, in the present exemplary, are not outlined by way of example by a display apparatus 145, but instead by markers applied fixedly to the wall 125. Shapes and sizes of the sections 140 can be uniform or differ from one another, as shown. Distances between the sections 140 can also be regular or irregular.

REFERENCE CHARACTERS

100 household appliance
105 operating apparatus
110 processing facility
115 first structure-borne sound sensor
120 second structure-borne sound sensor
125 body (wall, floor assembly)
130 location
135 user
140 section
145 display apparatus
200 method
205 determine function and/or section
210 display indication of function and/or section
215 detect structure-borne sound of first sensor
220 detect structure-borne sound of second sensor
225 pattern matching
230 determine location
235 determine associated section
240 determine associated function
245 control function
250 learn pattern

The invention claimed is:

1. An operating apparatus for a household appliance, the operating apparatus comprising:

first and second structure-borne sound sensors;

said structure-borne sound sensors configured to be applied to, and spaced apart from one another on, a surface of a predetermined body; and a processing facility configured:

to determine, based on sensor values from said structure-borne sound sensors, a location on the surface of the body at which a pulse was introduced into the body;

to determine that the location is situated in a predetermined section of the surface of the body;

to determine a function of the household appliance associated with the section; and to trigger or control the function in the household appliance; and a display apparatus having a projector, said projector being directed toward the surface of the body, and said display apparatus configured to provide a visual indication on the surface of the body, said visual indication indicating said predetermined section or a plurality of predetermined sections.

2. The operating apparatus according to claim 1, wherein the body is included in the household appliance.

3. The operating apparatus according to claim 1, wherein the household appliance is configured to rest against the body.

4. The operating apparatus according to claim 1, which further comprises a further structure-borne sound sensor, said structure-borne-sound sensors configured to be applied in pairs to, and spaced apart from one another on, the surface of the body.

5. A method for controlling a household appliance, the method comprising:

providing first and second structure-borne sound sensors applied to, and spaced apart from one another on, a surface of a predetermined body;

using a display apparatus with a projector directed towards the surface of the body to provide a visual indication on the surface of the body;

using the visual indication to indicate one or a plurality of predetermined sections of the surface of the body;

detecting structure-borne sound at locations spaced apart from one another on the surface of the body;

using a processing facility for determining, based on sensor values from the structure-borne sound sensors, a location on the surface of the body at which a pulse, producing the detected structure-borne sound, acts on the surface;

using the processing facility for determining that the location is situated in the one or plurality of predetermined sections of the surface;

using the processing facility for determining a function of the household appliance associated with the one or plurality of predetermined sections; and using the processing facility for triggering or controlling the function of the household appliance.

6. The method according to claim 5, which further comprises identifying a predetermined pulse based on a pattern of a sensor signal.

7. The method according to claim 6, wherein the pattern relates to a temporal course of the signal.

8. The method according to claim 6, wherein the pattern relates to a frequency spectrum of the signal.

9. The method according to claim 6, which further comprises automatically learning the pattern.

* * * * *